US005431858A

United States Patent [19]

Harrison, Jr.

[11] Patent Number: 5,431,858

[45] Date of Patent: Jul. 11, 1995

[54] ENERGY CONSERVING FLUID FLOW DISTRIBUTION SYSTEM WITH INTERNAL STRAINER AND METHOD OF USE FOR PROMOTING UNIFORM WATER DISTRIBUTION

[75] Inventor: Richard H. Harrison, Jr., Columbia, Md.

[73] Assignee: Baltimore Aircoil Company, Inc., Jessup, Md.

[21] Appl. No.: 227,619

[22] Filed: Apr. 14, 1994

[51] Int. Cl.[6] ..... B01F 3/04

[52] U.S. Cl. ..... 261/5; 261/111; 261/DIG. 11

[58] Field of Search ..... 261/111, 110, 5, 153, 261/DIG. 11

[56] References Cited

U.S. PATENT DOCUMENTS

| | | | |
|---|---|---|---|
| 2,011,828 | 8/1935 | Rich et al. | 261/111 |
| 3,353,802 | 11/1967 | Greer | 261/110 |
| 3,875,269 | 4/1975 | Forchini et al. | 261/111 |
| 4,032,604 | 6/1977 | Parkinson et al. | 261/66 |
| 4,579,692 | 4/1986 | Bugler III, et al. | 261/111 |
| 4,592,878 | 6/1986 | Scrivnor | 261/111 |
| 4,720,358 | 1/1988 | Cropp | 261/111 |
| 5,120,435 | 6/1992 | Fink | 261/5 |
| 5,180,528 | 1/1993 | Kaplan | 261/111 |
| 5,232,636 | 8/1993 | Cates et al. | 261/111 |

*Primary Examiner*—Tim R. Miles

*Attorney, Agent, or Firm*—Edward J. Brosius; F. S. Gregorczyk; Thomas J. Schab

[57] ABSTRACT

A side feeding fluid distribution system is provided which is used for uniformly distributing a heat exchange fluid to an underlying structure. The distribution system comprises a distribution pan, a pre-distribution box, and a removable basket strainer housed within the pre-distribution box. The fluid transporting pre-distribution box is centrally located in resting relationship on top of the distribution pan. The pre-distribution box has a pair of uniquely configured converging sidewalls which allow portions of the flowstream to be incrementally stripped from the main flowstream as it flows towards the backwall of the pre-distribution box. The velocity energy of the stripped portion of flow is thereby conserved, and then advantageously used to create uniform water distribution throughout the distribution pan, and hence, to the nozzles attached in the bottom of the pan. The pre-distribution box sidewalls also form an internal chamber for receiving a removable in-line basket filter or strainer. The strainer removes any pipe scale or water system debris to ensure that the nozzles will not clog and cause non-uniform water distribution.

23 Claims, 6 Drawing Sheets

ENERGY CONSERVING FLUID FLOW DISTRIBUTION SYSTEM WITH INTERNAL STRAINER AND METHOD OF USE FOR PROMOTING UNIFORM WATER DISTRIBUTION

BACKGROUND OF THE INVENTION

1. Field of the Invention

This invention relates to an improved fluid distribution system for continuously distributing hot fluid evenly across the top face of a fill assembly in a cross-flow water cooling tower. Specifically, this invention provides an uniform fluid head to the distribution pan and provides an in-line basket filter to prevent clogging of the metering nozzles in the pan.

2. Description of the Prior Art

Evaporative water cooling towers are well known in the art and generally involve pumping a hot heat exchange liquid (usually water) up to and evenly across an open distribution basin at the top of the tower wherein a heat exchange or fill media gravitationally receives the hot water descending through basin nozzles, in an intimate, evaporative, heat exchange relationship with a stream of cool air passing horizontally through the fill assembly. The cooled water is ultimately collected in an underlying sump and then returned to an offsite process which continuously uses the cooled water in a heat exchange type of application. Cooling towers of the type described may employ natural draft techniques for creating the cross-flow movement of cooling air through the fill assembly such as by utilization of a hyperbolic stack or they may employ a mechanical device such as a common propeller fan or a forced or induced draft centrifugal fan. In any event, when the air contacts the water, heat and mass transfer occur simultaneously, resulting in a small portion of the hot water being evaporated into the air. The energy which causes the water to evaporate is supplied from the release of sensible heat from the hot water. Accordingly, as the sensible heat is liberated from the hot water, the water temperature is reduced and cooling is accomplished. The air stream is used for sweeping away the evaporated water, and is exhausted from the tower as a moist, warm, air stream.

It is the functional objective of conventional cooling apparatus distribution basins to receive the incoming stream of hot water and direct the same toward a plurality of spaced metering nozzles located in the bottom of the basin for uniform discharge across the top face of the underlying fill media. Depending upon the required cooling capacity, water flow rates into the apparatus distribution basin can be on the order of 200 to 1600 gallons per minute or more. With the larger capacity requirements, the upper face of the fill media may be of such dimensional size that some of the more remote metering nozzles are located a significant distance from the hot water inlet supply pipe, making uniform water distribution difficult.

The amount of water which passes through each of the nozzles depends upon the size and type of nozzle, as well as the head pressure of water above the nozzle. Cooling towers typically provide metering nozzles that are equivalent in diameter and are spaced at precise intervals. As a result, the major variable affecting the rate of water flow through the nozzles is the amount of water head pressure above each of the nozzles. Accordingly, it is critical to provide a uniform water head pressure above each of the nozzles throughout the entire area comprising the distribution basin.

Moreover, when incoming flows are applied to an open distribution basin, a resultant steady state water depth is typically found where the water level is shallower near the inlet supply pipe than at the opposite end of the basin. To some extent, this problem is caused by flow turbulence, which causes unsteady water levels throughout the basin such that the static head to each nozzle becomes variable. Under these conditions, the nozzle discharge flow rate can be uneven, if not substantially unpredictable. Most often though, as when the water flow rates approach maximum levels, the total energy of the water can cause the water to "shear" across the tops of the nozzles closest to the inlet supply pipe and not allow the water to downwardly descend into the nozzles. More specifically, this condition exits due to the total energy actually consisting of a velocity energy component and a static energy component, with the velocity energy component being very large near the inlet supply. Such a condition will cause a reduced flow of water through the nozzles closest to the supply pipe even though sufficient water head exists.

In an effort to distribute the incoming hot water to all of the metering nozzles uniformly, various methods and devices have been devised. One such method for providing uniform water distribution to a cross-flow cooling tower is described in U.S. Pat. No. 4,579,692, and involves feeding the hot water into the distribution basin from an overhead supply pipe which is central to the basin. That distribution system utilizes a stilling chamber and a flume contained within the chamber to receive water above the distribution pan. One end of the stilling chamber is connected to the overhead supply pipe and the other end is connected to the flume at its center, thereby providing separate flume sections which extend longitudinally from the center of the basin to each basin, or tower edge. As the hot water flows into the stilling chamber and reverses direction, it loses its velocity energy before flowing into the flume, where it overflows the sidewalls and uniformity distributes across the basin.

Another method for providing uniform water distribution to a cooling tower basin is described in U.S. Pat. No. 5,180,528, where the hot water supply pipe is brought in from the bottom of the distribution basin at one corner of the tower. The distribution system described in this patent utilizes an inlet chamber that is connected to a side of a flume co-extending the longitudinal length of the distribution pan. An internal flume weir wall co-extends the length of the flume. As the hot water enters the chamber from the bottom, it changes direction by 90° and loses its velocity energy before it enters the flume. Once inside the flume, it travels the longitudinal length of the basin, eventually overflowing the internal weir walls. Baffles attached to the basin then direct the water to the nozzles.

Another arrangement utilizes a centrally located, and top feeding pre-distribution box internally containing a flow proportioning valve and a system of weir plates for evenly distributing the hot water throughout the box for eventual distribution in the basin. This arrangement is described in U.S. Pat. No. 4,592,878.

Most of the top feed arrangements have either utilized a centrally disposed pre-distribution box or a flume, located at the distribution pan back side, for changing the direction of flow by 90° as a means for equalizing the flow in all directions.

All of the methods described above have been successful in providing even water distribution to a distribution basin where the hot water to be cooled is supplied from either above or below the basin, but none of the above methods consistently provide a low pressure loss arrangement across a wide range of turndown ratios as does the present invention. Furthermore, the present invention even includes an in-line strainer or filter within the pre-distribution box for ensuring continued uniform distribution by removing system debris which can lead to nozzle clogging and uneven water distribution. The strainer of the present invention is constructed such that it does not effect the pressure of the water as it flows through the pre-distribution box.

In any of the above mentioned systems, it is possible to add an in-line filter in the system piping. However, even with the simplest filter, one which spans the piping diameter, the pressure losses can be significant due to the reduction in the effective cross-sectional area. Most in-line filters of this type reduce the open cross-sectional area to about fifty percent, thereby forcing the water velocity to increase to approximately twice the original velocity with a significant pressure drop. When filters of this type begin to clog, the open area of the filter is reduced even further, creating even greater pressure loesses that cause the water flow to be reduced and possibly result in total shutdown of the system because the supply pump cannot overcome the additional pressure losses. As an example, a design pipe velocity of 8 ft/sec with a 50% open filter would have additional pressure loss of approximately 1.7 feet of water. If the filter clogged to only 25% open, the pressure loss would increase to approximately 6.8 feet of water. If it clogged to only 10% open, the pressure loss would increase to 42.5 feet, which happens to be 40.8 feet more than the base clean system! There is almost no cooling apparatus piping system that can handle this additional loss. Most systems are designed with only minimal reserve of balancing valves and anticipated pipe future scaling. The most common result would be that the maximum shut-off pressure of the pump would be exceeded, and no water would flow through the system, thereby shutting down the whole cooling system.

An alternative to an in-line filter arrangement is to provide a larger, basket-type strainer as a means for lowering the initial pressure drop across the strainer, as well as for lowering the total pressure losses as the strainer becomes clogged. This situation is obviously an undesirable choice in that it requires larger, more costly equipment and the room to include it in the system. Consequently, a high percentage of the water distribution systems do not contain either of such filters. As a result, many distribution systems ultimately experience uneven water distribution due to pipe scale and other debris clogging the nozzles. Furthermore, when the apparatus is operating, it is practically impossible to clean an in-line filter or basket strainer without shutting down the system.

SUMMARY OF THE INVENTION

One of the main objects of the present invention is to resolve the difficulties noted above by providing uniform water distribution with an extremely low amount of pressure loss.

It is another object of the present invention to provide an in-line water filtering system that eliminates the normal requirement to access the nozzles for cleaning and eliminates the added cost of adding a separate filter system for debris removal.

A final object of the present invention is to provide an uniform water distribution system which operates over a wide range of flow rates without requiring special flow-tuning devices in order to create uniform flow distribution even when the turndown ratios are as high as 8 to 1. Briefly stated, the physical structure of the present invention is arranged to conserve the total energy of the flowing water, specifically the velocity energy component, and advantageously using that energy so that the above-stated objectives are satisfied over a wide range of turndown ratios.

DETAILED DESCRIPTION OF THE PREFERRED EMBODIMENT

Figure 1:
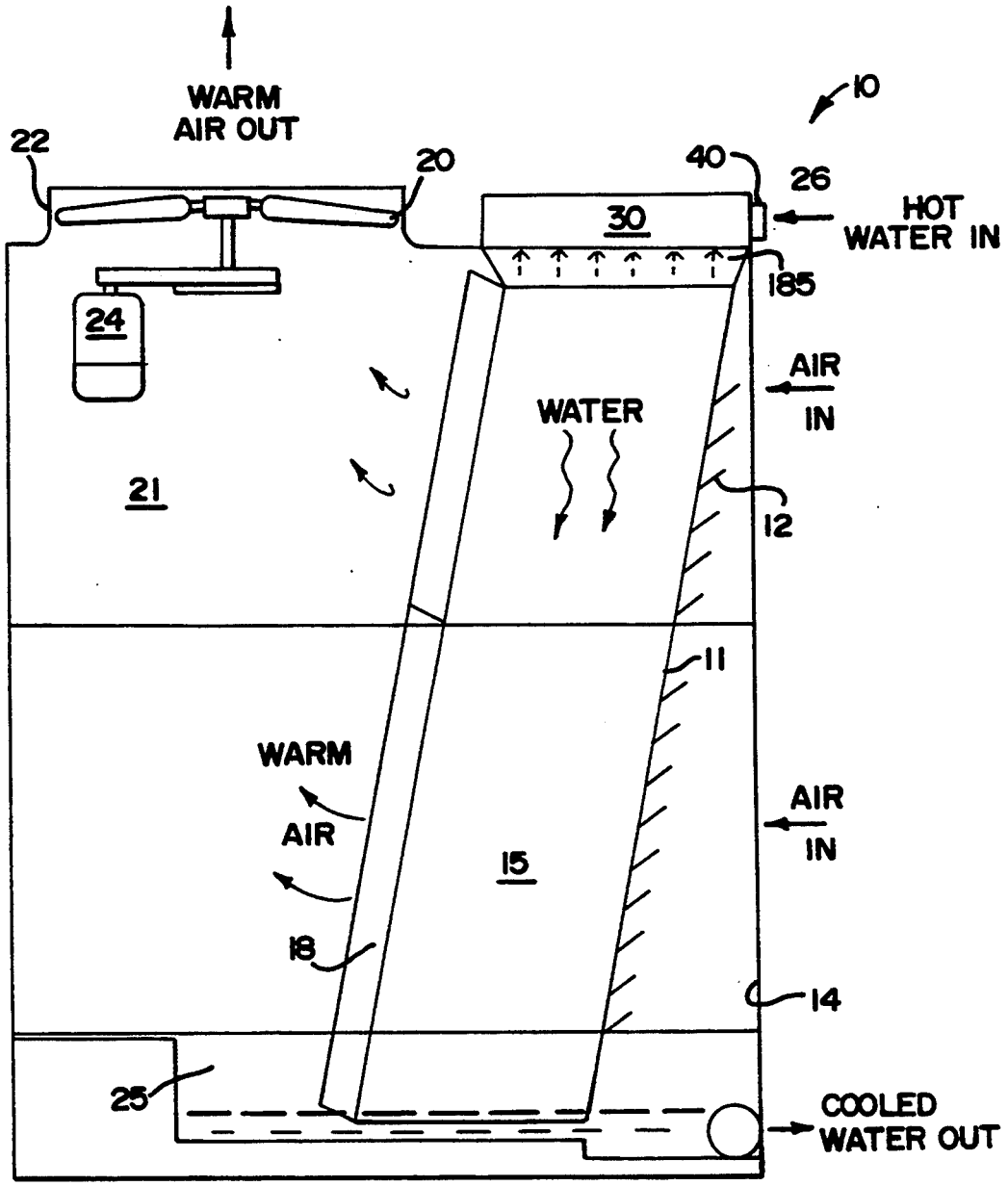
FIG. 1 is a side cross sectional view generally showing the air and water systems of a crossflow cooling tower incorporating the present invention.
Figure 1A:
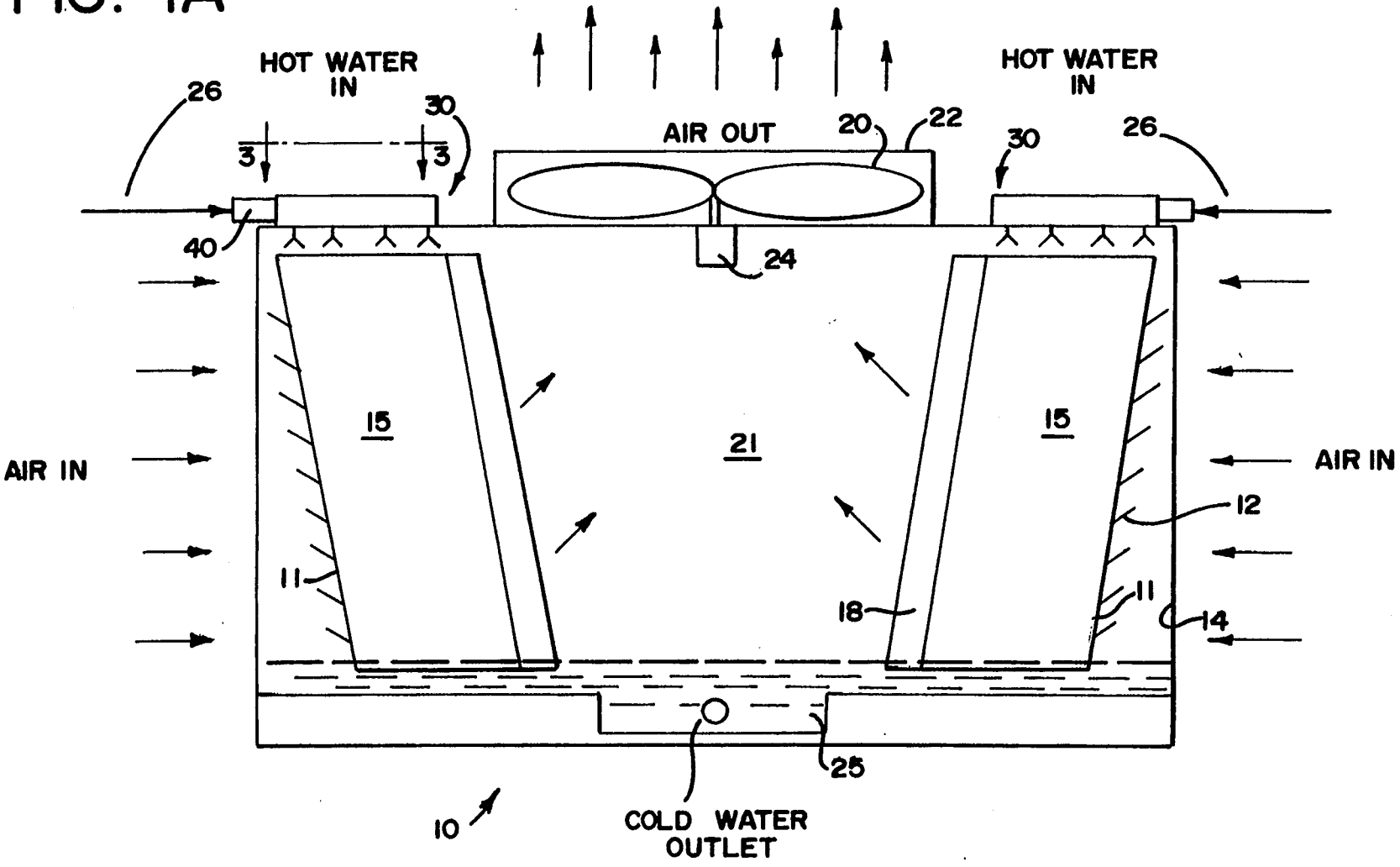
FIG. 1A is a side cross sectional view generally showing the air and water systems of a dual-banked crossflow cooling tower incorporating the present invention.

Referring now to FIG. 1, a mechanical draft cross flow cooling apparatus is designated by the numeral 10 and conventionally consists of a single, operable cell 11. For the sake of this discussion, a cell is considered as being a heat exchange apparatus which has individual and controllable water and air inputs. The single cell apparatus 10 further includes a foundation which supports a cold water collection reservoir or sump 25 at the bottom of the single bank of heat exchange fill media 15. In the single cell, dual-banked heat exchange apparatus of FIG. 1A, the sump 25 will typically be common to each of the banks of fill media 15. Internally, apparatus 10 has a frame or enclosure 14 which supports the outwardly inclined bank or banks of heat exchange fill media 15, with the area in front of the fill defining an air inlet 12, while the back of the fill defines an air outlet 18. Air is drawn through fill media 15 in a cross-flow fashion to evaporatively exchange heat with the hot water which is distributed across and descends each respective bank. The air is then is drawn into the internal chamber 21 by means of a fan 20, for upward discharge from the tower through fan shroud 22. The fan 20 is shown as being mechanically driven by motor 24 and is of the commonly known propeller type, although an induced or forced draft centrifugal fan can also be used. It is also possible to draw air through apparatus 10 simply through a natural draft.

Figure 2:
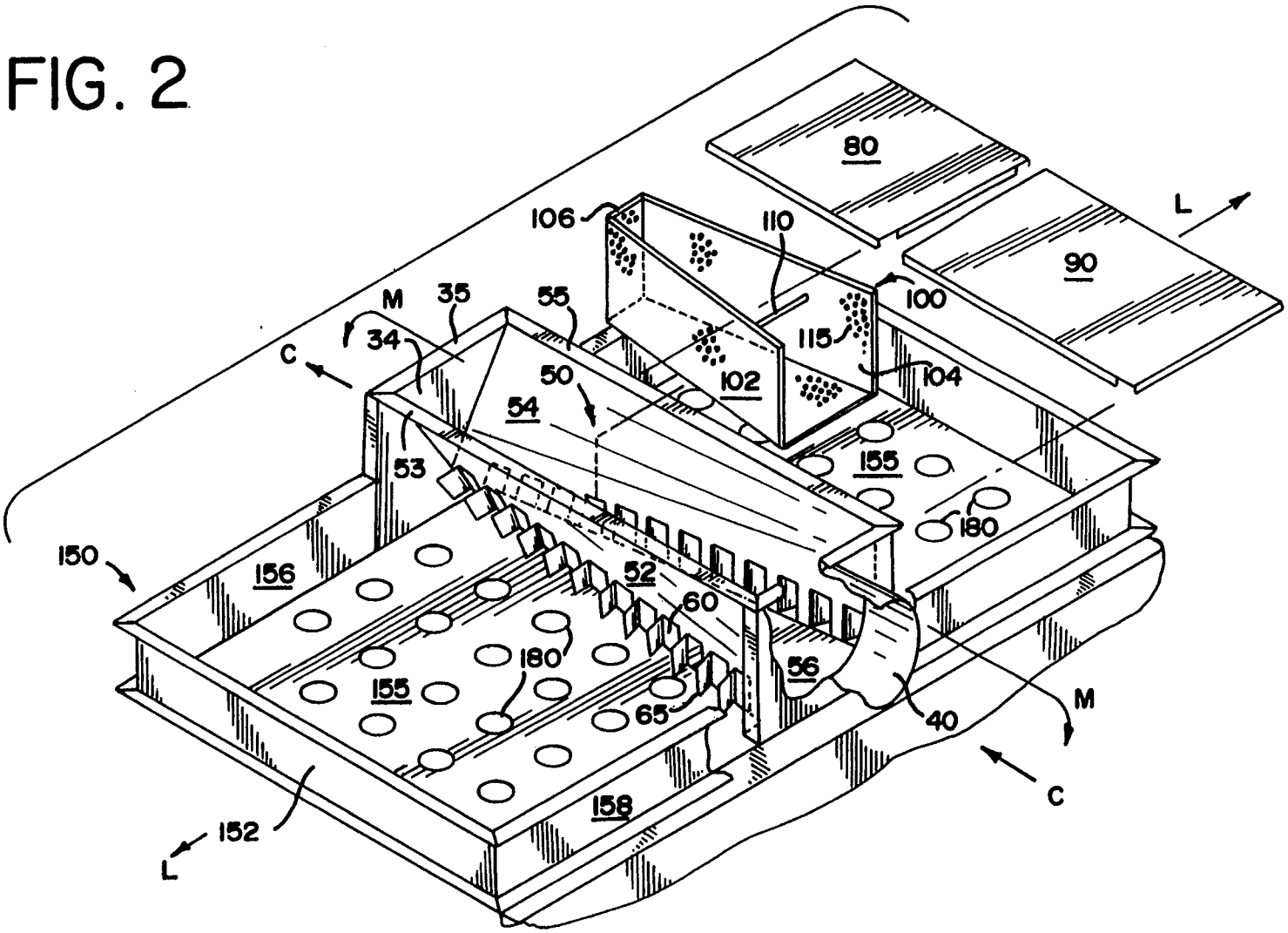
FIG. 2 is an exploded isometric view of the pre-distribution box of the present invention, including the internal strainer.

Hot water is supplied to each operable bank of fill 15 through a dedicated inlet supply pipe 26 that is typically located adjacent to and outside the structure 14, vertically extending to the top of apparatus 10. Depending on the type of apparatus, (single cell or dual-banked, single cell) the inlet supply pipe will feed a respective distribution pan 30 which is co-extensive with each operable bank of fill media 15. FIG. 2 illustrates that distribution pan 30 is comprised of a pair of spaced sides 156,158 that longitudinally extend parallel to axis L, as well as a pair of spaced ends 152,154, which cooperate with the sides to surround the perimeter of a distribution pan bottom 155. The upstanding sides and ends are typically constructed of channel and are attached to structure 14 by bolts and are usually provided with a sealing means (not shown). To ensure uniform distribution of water, bottom 155 is provided with a plurality of openings 180, through which the water is applied to the underlying fill media 15. Generally, the openings are provided with nozzles 185 for generating a fine spray which helps assure uniform distribution over fill media 15.

FIG. 2 also shows that the pre-distribution box 30 of the present invention is preferably located at the longitudinal midpoint of each operable bank of fill media 15. It is to be understood that the longitudinal midpoint of the fill media will be designated as such by line M-M. This same line will be used to also designate the longitudinal midpoint of the distribution pan 150 since it is co-extensive with media 15. Furthermore, the pre-distribution box 30 is to be understood as being centered over line M-M in this embodiment. Each fill media top on each operable bank, and hence, each respective distribution pan 150, is of a generally rectangularly shaped configuration of substantially equal size. For the sake of this presentation, the distribution pan 150 shown in the illustration is somewhat shorter in longitudinal length than typical. Typically, each distribution pan is at least three feet wide along ends 152,154, and at least eight feet long. With larger capacity apparatus, the longitudinal lengths will usually be either eight, ten, twelve, or fourteen feet long, with the width generally remaining constant. As mentioned, it is preferable that pre-distribution box 30 transverses the entire width of distribution pan 150, and be located at the longitudinal midpoint of the pan. In this example, it is envisioned that the distribution pan 150 has a longitudinal length of eight feet, therefore, it is preferred that pre-distribution box 30 be located four feet from either end 152 or 154.

As mentioned, pre-distribution box 30 is generally disposed perpendicular to axis L and should substantially be concurrent to the entering flowstream, which generally corresponds to the centerline of the inlet supply pipe 26. Throat or stub 40 typically extends perpendicularly from the front face 32 of box 30 a distance about of six inches so that the stub can be interconnected to the inlet supply pipe by a mechanical connector or by direct welding (not shown) in order to communicate hot water into distribution pan 150. The bottom of box 30, designated herein as 56, is generally superimposed above the base surface 155 of the distribution pan 150. It should be clear that since supply pipe 26 is connected to throat 40 at the side of box 30, the direction of the flowing hot water into pre-distribution box 30 will be generally perpendicular to the axis L, or concurrent to the entering flowstream and generally along a plane which is horizontal with respect to base 155. Once the water is received inside pre-distribution box 30, it is ultimately forced to change directions by 90°, thereby exiting box 30 in a direction parallel to axis L, yet still flowing along the same horizontal plane.

As seen from the illustration, the present invention also includes an internal basket strainer 100 which is wholly contained within pre-distribution box 30 when lids 80 and 90 are attached to box 30. What is unique about this strainer design is that it does not affect the distributing characteristics of the pre-distribution box. A traditional design would have a strainer going the total length in close proximity to the side opening of the pre-distribution box. Unfortunately, there would be two major problems, first only a small portion of the strainer would be effective, namely that which directly covers the opening. This would mean that the strainer would probably clog fairly quickly. However, more importantly, the second problem is that as the strainer begins to clog, it would occur at the opposite end which would detrimentally affect the flow distributing characteristics of the box thereby causing hot water spillout and thermal performance degradation. For this reason, most tower manufactures would not incorporate a strainer into their distribution box, but would request that the owner supply a separate basket type somewhere in the system. Now looking back at the specifics of strainer we can see that rear lid 80 is permanently attached to box 30 by known methods such as tack welding, bolting, or screwing, while the front lid 90 is removable so that basket strainer 100 can be removed for cleaning. Basket strainer 100 is generally made of galvanized steel, stainless steel, plastic, or any other type of non-corrosive material and contains a matrix of perforations 115 across each of the wall 102, 104, 106 and floor 108, thereby forming a sieve-like structure for removing debris entrapped in the water. The advantage of having the basket strainer 100 inside pre-distribution box 30 at the top of the tower, is that any debris or pipe scale which becomes entrapped in the hot water will be screened at the last possible location before it has a chance to block nozzles 185 and thereby prevent the uniform distribution of water throughout media 15. Basket strainer handle 110 facilitates easy removal of the entire basket strainer for clean out of any debris collected within the strainer. It should be understood that due to the operable water pressure, the collected debris has a tendency to collect along back wall 106 and therefore, does not create a starvation problem for water flowing through the basket. It is envisioned that pressure taps at the front and rear of the basket can be included in order to remotely provide a signal of the pressure drops across the basket, wherein an increased difference in pressure indicates an accumulation of debris in the basket.

Figure 3:
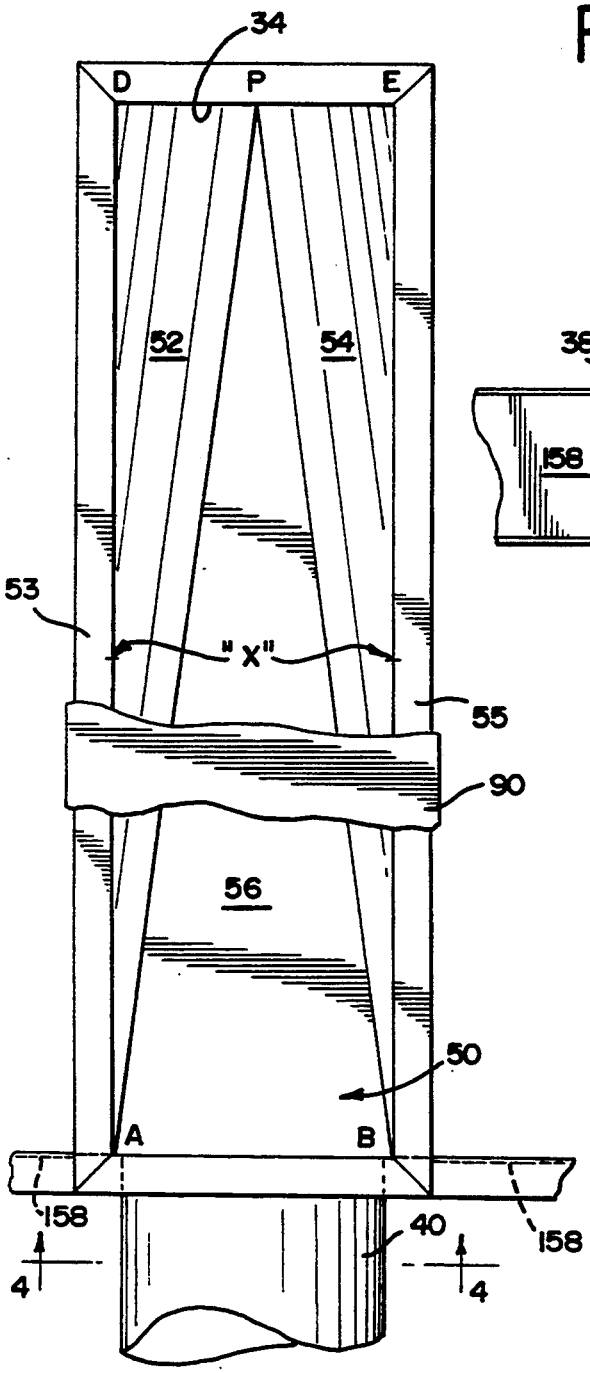
FIG. 3 is a plan view of the water pre-distribution box of the present invention with the strainer removed.
Figure 4:
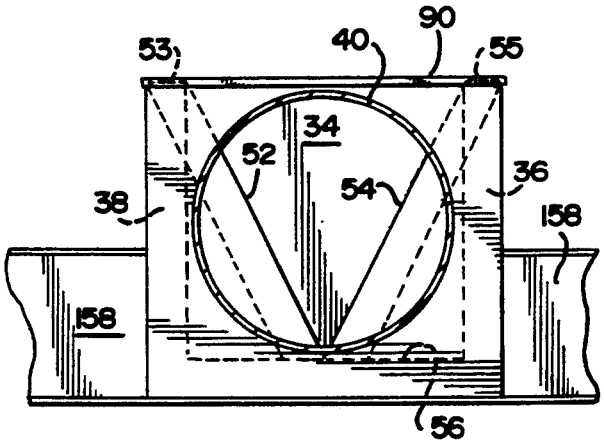
FIG. 4 is a front view taken along line 4—4 of FIG. 3, of the water distribution box of the present invention.
Figure 5:
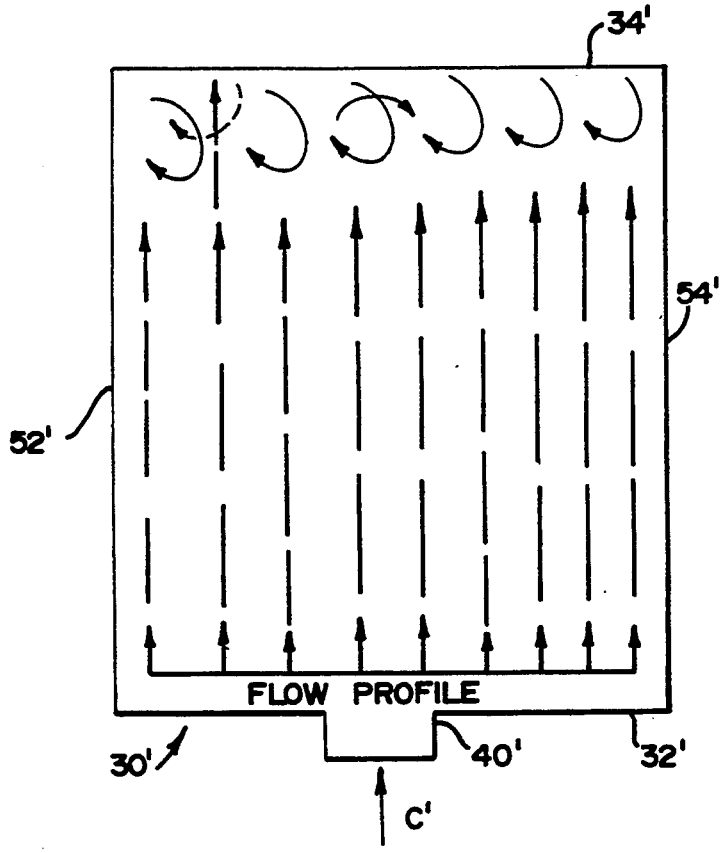
FIG. 5 is a plan view of a prior art distribution box showing how the water flow stream enters the box and stagnates at the rear.
Figure 7:
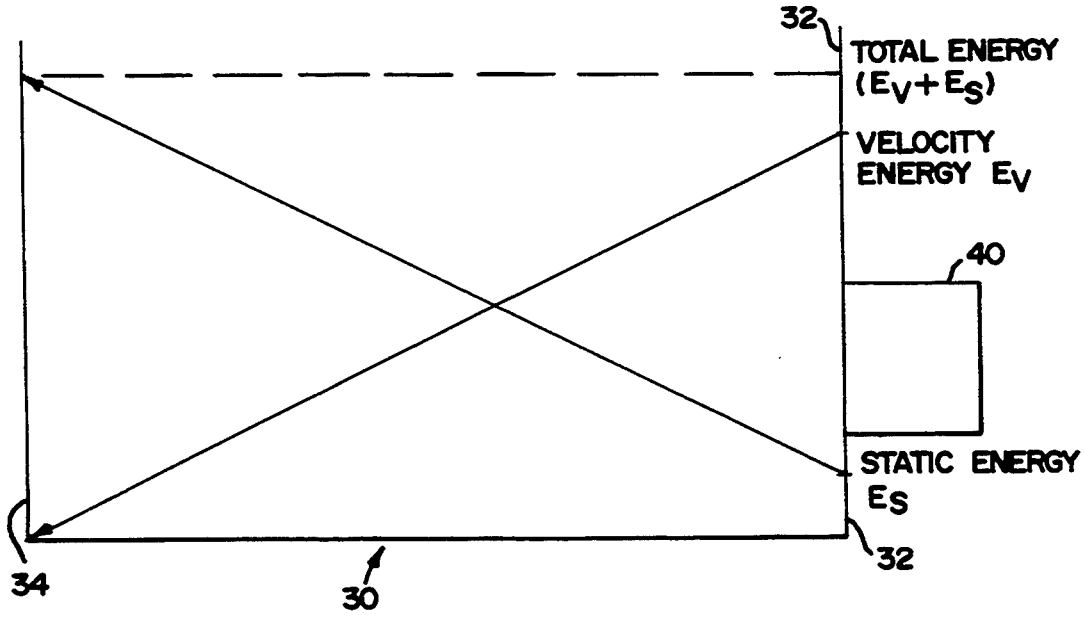
FIG. 7 is an elevation view of a pre-distribution box of the present invention emphasizing the relationship of total energy, velocity energy, and static energy along the depth of the box.

Referring now also to FIGS. 3 and 4 in conjunction with FIG. 2, the operation of the pre-distribution box 30 of the present invention will now be explained in greater detail. One important aspect of the pre-distribution box of the present invention is the relatively compact size and lightweight construction which is the necessary result of the ability of the box to conserve and then use the total energy of the flowing water to an advantage. As seen from FIGS. 2–4, the pre-distribution box 30 is generally square at the connection end with the inlet supply pipe and gradually undergoes a transition towards a triangular cross section at the opposite end, thereby forming an internal passageway 50. This square-to-triangular transition provides the means for conserving the velocity flow energy in the water as it travels along axis C, and towards the back wall 34 of box 30, without the requirement of high pressure drop resistances which are not inherently efficient. More specifically, the water entering the throat or stub 40, has a total energy $E_T$, which is equal to the sum of the velocity energy ($E_V$) and the static pressure or energy ($E_S$), which for all practical purposes, can be presumed to remain constant along the length of the pre-distribution box due to the laws of conservation of energy. Unlike prior art distribution header arrangements, the specific design of the pre-distribution box having this particular type of transition, actually promotes the conservation of the velocity energy in the water by gradually reducing the cross-sectional area of the header as the distance from the entrance is increased, and by stripping off portions of the flowstream before the velocity component of the flowstream can be converted into static energy. By that, a referral to FIG. 5 is necessary in order to explain what is meant. FIG. 5 shows how the flowstream in a prior art distribution box would behave, wherein the box is constructed with square or nonconverging sidewalls. It is seen that the entire flow profile enters throat 40' and continues straight through until it reaches the backwall 34'. During that travel, the energy comprising the flowstream is representative of the flowstream seen in FIG. 7, where the total energy at throat 40' has a very high velocity energy component and a low static energy component, the sum of the two components comprising the total energy. As FIG. 7 shows, as the flowstream moves backwards in the box, the laws of the conservation of energy, as taught by Bernuolli's Law, cause the velocity energy to be converted into static energy. By the time the flow reaches backwall 34', the flow becomes stagnated (no velocity), yet still exhibits the same total energy or pressure as upon entrance into the distribution box. This total energy is now in the form of static pressure. Thus, if a nonconverging or square-walled pre-distribution box were used, the stagnation pressure would cause a very small opening at the back of the box to expel almost all of the water when compared to the same size hole at the front of the box. The velocity energy at the front of the box is too high to allow the water to enter through the opening; in this case, it would "shear" right pass the opening. Prior art distribution systems compromised this effect by making the holes in the back of the distribution box smaller, but this method is inefficient from an energy standpoint, because it requires a larger pressure drop to efficiently "squeeze" the water out of the openings, especially in the front of a box where there is hardly no static energy component. This total energy has to be additionally supplied by the pumping source. Furthermore, by providing this additional energy, the system and hence the pre-distribution box, become pressurized.

Figure 6:
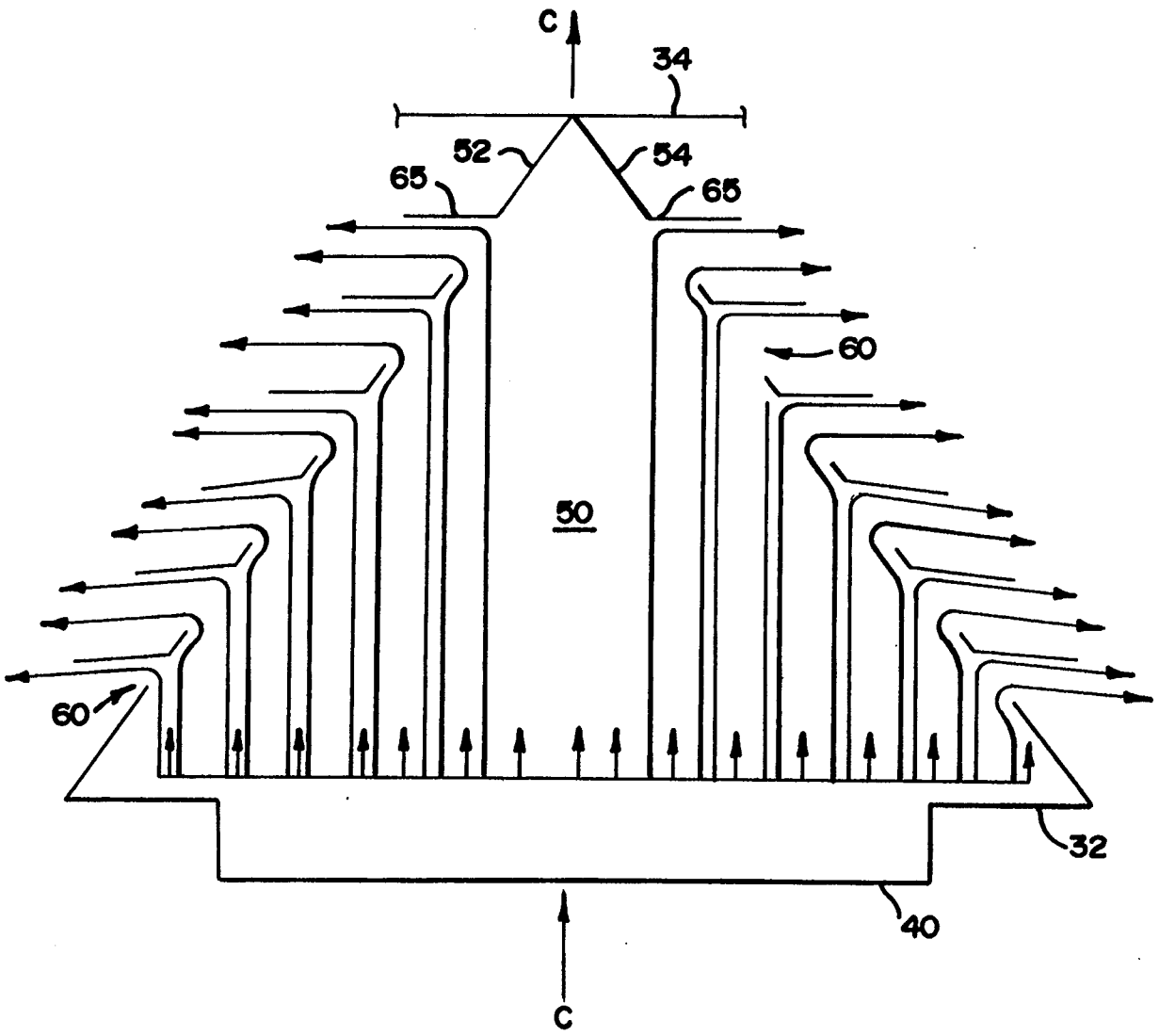
FIG. 6 is an exaggerated plan view of the pre-distribution box shown in FIG. 3 showing how the increments of flow are stripped from the main flow profile, as well as how the baffle angle accounts for stripped flow under the baffle to create an effective 90° flow.

On the otherhand, the pre-distribution box of the present invention (FIG. 6) does not allow the velocity component to be converted into static pressure since the sidewalls are arranged to converge. When the flow enters stub 40, the flow will still decrease in velocity energy as it travels towards the backwall, but now, almost all of the flow is stripped off incrementally as the flow travels rearwardly. As seen in FIG. 6, the arrangement of the walls necessarily forces the flowstream of water into the sidewall openings 60 since the total energy in the water would naturally keep the flowstream traveling in the direction along axis C. The flowstream near the front of the box enters the very first opening 60 and gets "stripped" from the remaining flowstream, then is forced into the distribution pan 150 by the flow deflector or baffle plate 65. Likewise, as the remainder of the stream continues towards the back of the box, each succeeding opening strips another part of the flowstream and diverts it into the distribution pan. This process continually takes place until the very last opening receives, then diverts, the last portion of the flowstream. Unlike the prior art systems, the complete flow profile of the present invention is not allowed to reach the back of the box and stagnate. Therefore, the box never becomes pressurized and more importantly, the flow profile is diverted from the box, into the pan, with essentially almost no pressure loss. This lack of pressure loss becomes extremely critical in low pressure systems where almost all of the total energy is comprised of the velocity energy component.

In most water distribution systems, the static pressure at a specific location is the key factor that determines the flow through that opening. If the static pressure at two locations differs by a factor of four, then the flow through the same size opening would differ by a factor of two (the square root of the static pressure ratio). A moderate pressure spray system, say 10 psi and nominal pipe velocities of 8 ft/sec, would only experience a variation in static pressure of 4.3 percent from one end to the other. This would translate into only a 2.1 percent flow difference for the same size opening. However, if we reduce the static pressure from 10 psi to a low pressure system of only 6 inches of water (0.2 psi), the static pressure would then differ by 199 percent and the flow would vary by 72.8 percent for the same size opening. Now it is possible to compensate for this variation in static pressure by varying the size of the openings, say making the openings at the low static pressure location 72.8 percent larger than the high pressure end. This would yield a distribution with approximately equal flows out the different openings. However, if the flow was cut in half, this arrangement would result in a static pressure difference of only 49.6 percent (instead of the original 199 percent) which would result in a flow imbalance of 50.5 percent (72.8 percent size difference minus 22.3 percent (square root of the pressure difference)). As this illustrates, it is very difficult to design low pressure distribution system that will handle a range of flows. This is why many of the top and bottom feeding prior art distributor systems compensate for this phenomenon by causing the water to totally change or reverse flow direction by 90°, usually along a different plane, in order to convert the velocity energy into a higher static pressure and then to rely solely on this higher static pressure to achieve a uniform distribution. However, one disadvantage in relying on, and trying to use direction change in an efficient manner is that it requires a flume or weir wall arrangement along most of the length of the fill media to be effective by minimizing flow velocities in these components. These arrangements may also require structural additions to the tower, thereby adding to the overall tower height, displeasing aesthetics, and increased construction and operating costs. Furthermore, those types of arrangements are still somewhat sensitive to flow turn-down ratios (they could not handle a 8 to 1 ratio). Design modifications would be necessary to handle different flow regimes.

By viewing FIGS. 2–4, it is seen that the pre-distribution box 30 of the present invention is composed of three sections; the front wall 32, the back wall 34, and the central body. It should be understood that the simple construction of the pre-distribution box of the present invention is a feature of the invention which enhances the attractiveness of this device. More particularly, the central body is preferably constructed from a single piece of material. As seen from FIGS. 3 and 4, it is envisioned that the central body is preferably constructed from galvanized sheet metal having a thickness of at least 18 gauge so that brakes X and Z can be fabricated in the usual matter, thereby forming floor 56 and first and second walls 52, 54, as a single, integral piece. FIG. 3 illustrates that each of the sidewalls 52, 54 also have respective top ends 53, 55, which includes flanges for securing the front and rear covers 80, 90 (FIG. 2). A further advantage in constructing the center section as an unitary section also involves the conservation of materials being used while forming the rectangularly shaped openings 60 and the baffle plates or deflectors 65. It is preferable to punch the three sides of the rectangle, thereby forming each opening 60, and then folding the fourth side of the opening back, and using the material as an integrally formed baffle plate 65 instead of discarding it. In this way, separate material will not have to be cut and attached about each opening, thereby saving substantial construction and assembly costs. FIG. 3 shows that the main advantage for using the sheet metal material of the stated gauge is that once the brakes X and Z are initially stamped, the complicated square-to-triangular transition caused by the convergence of walls 52, 54 from the front wall 32 to the rear wall 34 and their ultimate joining at point P, is only accomplishable by folding or rolling over each of the respective side walls into a continuously curved surface. This means that each of the sidewalls near points A and B respectively, are constructed substantially vertical at or near the entrance throat 40. The "rolling" of the sidewalls is the result of the sidewalls being joined at point P in order to form the convergence in the walls. The rolling and convergence causes the bottom ends of the sidewalls near the floor 56 to be substantially vertical, while slowly transforming into an arcuately configured surface near the top ends 53,55, of the sidewalls. Thus, it should be realized that even though FIG. 3 shows sidewalls 52, 54 (respective triangles ADP and DEP) as being flat, in reality, they are arcuately curved, being especially pronounced near the rear wall 34. It should also be understood that the bottom end of wall 52 is represented by the line PA, while the bottom end of wall 54 is represented by the line PB. Furthermore, for future reference, each wall will have a longitudinal midpoint, herein shown as point "X" on each wall illustrated in FIG. 3.

As mentioned, openings 60 along the length of each wall 52, 54, are substantially disposed in a generally vertical direction. However, it should be understood that the critical feature of each wall in relation to the functional objective of the pre-distribution box, is that the ratio of the cumulative sum of the openings is larger than the cross-sectional area of the inlet supply pipe opening. It is preferable that the sum of the areas of all openings be at least twice the cross-sectional area of the inlet supply pipe and this ratio can even be allowed to be several times larger. As long as the cumulative area of all of the openings 60 remains large when compared to the inlet pipe opening, the pressure drop through the pre-distribution box system will remain minimal. Minimizing the amount of pressure drop or pressure losses through the pre-distribution box is another important feature of the present invention, for if the cumulative area of the opening 60 were less than indicated, the water could be prohibitely restricted from exiting the pre-distribution box without some stagnation. Detrimentally, this could cause pressuration of the pre-distribution box and would certainly cause increased pressure losses as the water tries to "squeeze" itself out the openings.

Contrary to this happening in the arrangement of the present invention, each of the pre-distribution box openings strips and then diverts a portion of the flow into the distribution basin, and all the openings cumulatively divert all of the flow entering the pre-distribution box. In fact, it is preferable to mount the throat or stub 40 as close to the bottom 155 of distribution pan 150, so that the water level inside pre-distribution box 30 is kept low and near as possible to the openings. When the apparatus is operating at full capacity, it is typical that the water level inside the box 30 never reaches higher than the height of the diameter of the inlet pipe, plus the additional amount of distance the throat 40 is raised off the pan bottom where securing the throat to the front wall 32. Even under full operating capacity, it is possible to remove each box cover 80 and 90, and even remove the basket strainer 100, while the tower continues to operate since the flow is being continuously stripped off and not allowed to accumulate in the pre-distribution box.

When viewing FIG. 2, it is seen that the openings 60 are rectangularly configured, although the actual shape of the opening is irrelevant to the operation of the invention as long as the cumulative area of all the openings satisfies the earlier mentioned criteria. Also, for the sake of this embodiment, the baffle 65 has a complementary shape as the opening 60 since they were formed from the material removed to form the opening. If cost is not important, the openings can be of any geometrical shape and the baffles could be separate pieces either screwed or welded into place.

Also illustrated in FIG. 2, it is important to realize that the openings 60 become reduced in vertical extent from about the mid-section of the pre-distribution box, to the back wall 34. This necessarily means that the openings 60 on the proximal end of each sidewall (designated in FIG. 3 as that portion of the sidewall represented by the extent of line AX and BX for each respective sidewall 52,54are all of an equivalent extent. This reduction is provided as such to account for the flow being incrementally stripped as it travels towards the rear of box, and since the remaining velocity energy in the flow gets converted into static energy near the back of the pre-distribution box. As explained earlier, since the total energy is constant along the length of the box, the smaller openings allow the same amount of water out of the opening as that exiting the front of the box. It was discovered experimentally, that the openings on the distal end of each sidewall(designated in FIG. 3 as that portion of the sidewall represented by the extent of line XD and XE for each respective sidewall 52,54) should have a vertical extent substantially equal to one half of the extent on the front openings.

Another important aspect of the present invention can be found in the required angularity of the deflectors 65, which was also determined experimentally. The unique arrangement of the deflectors was also found to be another factor as to why the present invention provides such consistent uniform distribution at turn down ratios as high as 8:1. It has been found that the proximal end of the sidewalls, and hence the box 30, must have deflectors angled greater than at the distal end of the sidewalls in order to offset the strong axial velocity component along the direction of the axis C, especially at the box inlet, where the velocity energy is very high-.(See FIG. 7) In the case where no baffles were present, it would be envisioned that some of the axial directed water (along the C axis) would exit each of the openings and be further directed in a direction parallel to the flow of the water internally along axis C. The total energy of these parallel and individual streams would keep the water going in a direction essentially straight until it encountered an outgoing stream from another successive opening. At that point, swirling vortex formations would form along the length of each pre-distribution box sidewall. Therefore, in order to counter this effect, each baffle near the front of the box must be angled greater than those at the rear of the box in order to offset this axial velocity. The proximal end of the box requires the baffles to be set at an angle approximately 75° from the flow axis C. It has been found that with this angularity, an "effective" 90° average flowstream out of each of the openings is formed since a very small part of the individual, stripped flow streams will escape under the deflector and eventually become balanced by the flow exiting the next successive opening, which has a substantial part of its flow exiting at a 75° direction. The remaining deflectors on the distal end of pre-distribution box 30 are bent at a 90° angle. The velocity on the back half of box 30 has been slowed due the stripping of flow through each opening and due to the interaction of the flow with the sidewalls and internal strainer; therefore a 90° baffle angle can be used to easily direct all the flow out to the distribution pan 150. It has been found experimentally that for a small distribution pan size, say about 3 feet by 8 feet, only six openings are necessary along the length or extent of each sidewall, with preferably the proximal end having three openings sets with 75° baffle angles, while the distal end has three openings set with 90° baffles. It should be realized that with larger cooling capacity systems, the number of openings, will vary, although the relative number of 90° baffles versus 75° baffles will be balanced. The specific cross-sectional requirements of the openings 60, as well as the angles of all the deflectors 65 add to the further refinement of even flow distribution by changing the direction of flow at the inlet, (along axis C) to essentially perpendicular to axis C, with practically no pressure losses through the openings. This feature provides uniform flow and distribution to the distribution basin across a range of turndown ratios for any particularly-noted apparatus capacity.

It will be appreciated that the present invention can be successfully retrofitted to other heat and mass exchange apparati which involves similar water distribution systems such as evaporative condensers, closed circuit fluid coolers and the like, but is especially adapted for use in cooling towers.

These and other arrangements incorporating slight modifications to the invention are to be limited only by the scope of the following claims and are not limited by any particular arrangement shown in the specification.

What is claimed is:

1. A fluid distribution system for an evaporative heat and mass exchange apparatus for communicating a heat exchange fluid flowstream to a heat exchange application, said heat exchange fluid flowing within an inlet supply pipe as a heated and high temperature fluid for cooling within said apparatus, said heat exchange fluid having a total energy comprised of a velocity energy component and a static energy component, said inlet supply pipe connected to a side of said apparatus, said apparatus including an enclosure, heat transfer media suspended within said enclosure, and means for moving air through said heat transfer media for evaporatively exchanging heat with said heat exchange fluid, said heat transfer media underlying said distribution system, said fluid distribution system comprising:

at least one gravity distribution basin having a bottom pan, upstanding first and second sides, and upstanding first and second ends cooperating with said first and second sides and said bottom pan to define said basin, said basin having a longitudinal axis parallel to each of said upstanding sides and a midpoint between said upstanding ends, said basin bottom pan further including spaced fluid metering means for evenly distributing said heat exchange fluid across said heat exchange media;

a pre-distribution box for transporting said heat exchange fluid from said inlet supply pipe to said distribution basin, said pre-distribution box superimposed above said bottom pan of said distribution basin and including a front and open pre-distribution box wall in communication with said inlet supply pipe for transporting said heat exchange fluid within said pipe in a direction generally from said front wall to said pre-distribution box back wall, thereby defining an first fluid flow path, said first fluid flow path substantially operable along a plane horizontal to said distribution pan, a first and a second pre-distribution box sidewall, each of said sidewalls having a top end, a bottom end, a proximal end and a distal end, said sidewalls arranged in spaced confronting relationship to each other with each of said sidewall proximal ends attached to said pre-distribution box front wall and each of said sidewall a distal ends attached to said pre-distribution box back wall, said sidewalls generally converging in a direction from said proximal end to said distal end such that each of said sidewalls are joined together at their respective said distal ends and include a midpoint between said proximal and distal ends, said sidewalls and said front and back walls cooperating to define an internal passageway, said pre-distribution box diverting said heat exchange fluid flowing within said box along said first flow path to a second fluid flow path, said second fluid flow path transposed at substantially a right angle from first said flow path and substantially operable along said same horizontal plane, said heat exchange fluid along said second flow path flowing in a direction generally from said pre-distribution box to each of said distribution basin ends, said pre-distribution box converging sidewalls arranged to operably conserve said velocity energy component of said heat exchanger fluid such that said fluid flow along said second flow path has a substantially uniform static fluid pressure head at each of said metering means and a minimal static pressure loss between a head pressure of said fluid flowing along said first flow path and a head pressure of said fluid flowing along said second flow path, said uniform static fluid pressure head and said minimum pressure loss experienced throughout a range of turndown ratios of said fluid flowstream.

2. The fluid distribution system of claim 1 wherein said pre-distribution box internal passageway has a cross sectional area which is at least equal to a cross sectional area of said inlet supply pipe, said internal passageway cross sectional area having a generally triangular shape.

3. The fluid distribution system of claim 2 wherein each of said sidewalls includes a series of horizontally arranged openings near said bottom end of each of said sidewalls, said openings communicating said heat exchange fluid from said first fluid flow path to said second fluid flow path, each of said openings having a generally similar geometric configuration.

4. The fluid distribution system of claim 3 wherein said sidewall openings have a cumulative cross sectional area which is greater than said cross sectional area of said inlet supply pipe.

5. The fluid distribution system of claim 4 wherein said converging sidewalls conserve said velocity energy by successively stripping off portions of said flowstream through each respective said opening in said series of openings before said velocity energy is converted into static energy.

6. The fluid distribution system of claim 5 further including deflectors attached to each of said openings for diverting said respective stripped portions of said flowstream within a respective said opening into said distribution pan.

7. The fluid distribution system of claim 6 wherein said deflectors on each of said sidewalls between said proximal end and said midpoint have a surface area which is about twice as large as a surface area of said deflectors between said midpoint and said distal end.

8. The fluid distribution system of claim 7 wherein said deflectors between said proximal end and said midpoint are arranged at an angle which is about 75° with respect to said first flow path, and said deflectors between said midpoint and said distal end are arranged at an angle which is about 90° with respect to said first flow path.

9. The fluid distribution system of claim 8 wherein all of said deflectors between said proximal and distal ends have a geometric configuration which is substantially similar to said geometric configuration of said openings.

10. The fluid distribution system of claim 9 wherein said pre-distribution box is disposed transverse to said distribution basin longitudinal axis and engaging said basin bottom pan at about said midpoint of said pan, wherein said back wall is integral with said distribution basin upstanding second side, and said front wall is integral with said distribution basin upstanding first side.

11. The fluid distribution system of claim 9 wherein said pre-distribution box is disposed substantially parallel to said distribution basin longitudinal axis for simultaneously providing said heat exchange fluid to said same distribution basin and to a second distribution basin, each of said distribution basins aligned side-by-side such that said same distribution basin first upstanding end is in positional agreement with a first upstanding end of said second distribution basin, and said same distribution basin second upstanding end is in positional agreement with a second upstanding end of said distribution basin, said pre-distribution box generally transverse to each of said distribution basin upstanding first and second ends such that said pre-distribution box first sidewall forms said same distribution basin first upstanding side and said pre-distribution box second sidewall forms a second upstanding side on said second distribution basin.

12. The fluid distribution system of claim 5 wherein said metering means is comprised of flow dispensing nozzles.

13. In a primary heat exchange apparatus having a cooling fluid distribution system for cooling a heat exchange fluid from a secondary heat exchange apparatus, a method of supplying a heat exchange fluid flowstream to said primary heat exchange apparatus for subsequent dispersion and distribution over an upper face of a fill media of said primary heat exchange apparatus, said primary heat exchange apparatus including an inlet supply pipe, a pre-distribution box having a front wall with an inlet, a backwall, and a pair of converging sidewalls, each of said pre-distribution box walls defining an internal passageway having a triangular cross-section, a distribution basin with a longitudinal axis and a basin midpoint located along said axis, and a pair of sides lying generally parallel to said axis, and a pan bottom with a plurality of gravity-fed nozzles therein, said method comprising:

communicating in a generally vertical direction, a spent heat exchange fluid from said secondary heat exchange apparatus within said inlet supply pipe to an inlet of said pre-distribution box, which inlet on said pre-distribution box is coupled to said supply pipe;

passing said heat exchange fluid flowstream into said pre-distribution box internal passageway and then successively stripping off portions of said flowstream before said flowstream converts a velocity energy component of said flowstream into a static energy component;

diverting the direction of each respective said stripped off portions of said flowstream to provide each respective said stripped off fluid flowstream portions in a substantially parallel direction to said distribution basin longitudinal axis;

dispersing each respective said stripped off flow portions uniformly throughout said distribution basin, wherein each of said gravity-fed nozzles equally experiences a uniform static pressure head above a said respective nozzle such that each of said nozzles evenly distributes said heat exchange fluid across an upper face of said fill media of said primary heat apparatus.

14. The method of supplying a heat exchange fluid flowstream to a primary heat exchange apparatus of claim 13, said method further comprising the step of placing said pre-distribution box at about said distribution pan midpoint such that said pre-distribution box substantially traverses said parallel axis of said distribution basin.

15. The method of supplying a heat exchange fluid flowstream to a primary heat exchange apparatus of claim 13, said method further comprising the step of placing said pre-distribution box substantially parallel to said longitudinal axis of said distribution basin along one of said sides of said distribution basin for providing said fluid flowstream to said distribution basin of said primary heat exchange apparatus in a direction substantially traverse to said longitudinal axis of said distribution basin, said pre-distribution box also supplying said fluid flowstream to a third heat exchange apparatus having a distribution pan in communication with said pre-distribution box, said third heat exchange apparatus arranged side-by-side with respect to said primary heat exchange apparatus.

16. An improved heat exchange apparatus for cooling a stream of flowing heat exchange fluid, said apparatus comprising:

at least one enclosure for supporting a heat transfer fill media, each said enclosure having an air inlet, an air outlet, a top and a bottom;

heat transfer fill media with a heat transfer surface, said fill media positioned in said enclosure such that a stream of air flow will enter said air inlet and exit said air outlet such that said air stream passes across said fill media heat transfer surface in a crossflow fashion;

means for moving a stream of air through said apparatus and said fill media, said means mounted in said enclosure top;

a sump at said enclosure bottom to collect said heat exchange fluid downwardly descending from said fill media;

a distribution system for uniformly distributing said heat exchange fluid across said fill media, said system comprising a pre-distribution box and a distribution basin having a bottom pan which contains a plurality of metering nozzles and has a longitudinal axis, said pre-distribution box having a front wall, a back wall and a first and second sidewall, each of said pre-distribution box walls cooperating to define an internal passageway for transporting said heat exchange fluid, said sidewalls converging from said front wall to said back wall such that said pre-distribution box has a cross sectional area which is generally triangular in shape;

an inlet supply pipe for communicating said heat exchange fluid from an offsite heat exchange application to said pre-distribution box of said distribution system;

a basket strainer having a sieve-like structure and which is complementary to said pre-distribution box passageway such that said strainer is received within said passageway for continuously filtering said heat exchange fluid so that said metering nozzles do not become clogged.

17. The improved heat exchange apparatus of claim 16 wherein said apparatus is a cooling tower.

18. The improved heat exchange apparatus of claim 16 wherein said apparatus is an evaporative condenser.

19. The improved heat exchange apparatus of claim 16 wherein said apparatus is a wet air cooler.

20. An improved heat exchange apparatus for cooling a stream of flowing heat exchange fluid, said apparatus comprising:

at least one enclosure for supporting a heat transfer fill media, each of said enclosure having an air inlet, an air outlet, a top and a bottom;

heat transfer fill media with a heat transfer surface, said fill media positioned in said enclosure such that a stream of air flow will enter said air inlet and exit said air outlet such that said air stream passes across said fill media heat transfer surface in a crossflow fashion;

means for moving a stream of air through said apparatus and said fill media, said means mounted in said enclosure top;

a sump at said enclosure bottom to collect said heat exchange fluid downwardly descending from said fill media;

a distribution system for uniformly distributing said heat exchange fluid across said fill media, said system comprising a pre-distribution box and a distribution basin having a bottom pan which contains a plurality of metering nozzles and has a longitudinal axis, said pre-distribution box having a front wall, a back wall and a first and second sidewall, each of said pre-distribution box walls cooperating to define an internal passageway for transporting said heat exchange fluid, said sidewalls converging from said front wall to said back wall such that said pre-distribution box has a cross sectional area which is generally triangular in shape;

an inlet supply pipe for communicating said heat exchange fluid from an off-site heat exchange application to said pre-distribution box of said distribution system.

21. The improved heat exchange apparatus of claim 20 wherein said apparatus is a cooling tower.

22. The improved heat exchange apparatus of claim 20 wherein said apparatus is an evaporative condenser.

23. The improved heat exchange apparatus of claim 20 wherein said apparatus is a wet air cooler.

* * * * *